US011548126B2

(12) United States Patent
Sekiya

(10) Patent No.: US 11,548,126 B2
(45) Date of Patent: Jan. 10, 2023

(54) SCREWDRIVER

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 189 days.

(21) Appl. No.: 16/850,218

(22) Filed: Apr. 16, 2020

(65) Prior Publication Data

US 2020/0331128 A1 Oct. 22, 2020

(30) Foreign Application Priority Data

Apr. 19, 2019 (JP) ..... JP2019-080338

(51) Int. Cl.
*B25B 23/147* (2006.01)
*B25B 21/00* (2006.01)

(52) U.S. Cl.
CPC ..... *B25B 23/147* (2013.01); *B25B 21/008* (2013.01)

(58) Field of Classification Search
CPC ..... B25B 21/00; B25B 21/008; B25B 23/00; B25B 23/005; B25B 23/02; B25B 23/04; B25B 23/14; B25B 23/1422; B25B 23/147; B25B 23/1475; B25B 23/18
USPC ..... 173/2, 4, 11, 20, 176
See application file for complete search history.

(56) References Cited

U.S. PATENT DOCUMENTS

2014/0139406 A1* 5/2014 Backhaus ..... B25B 23/1422 345/8
2014/0259599 A1* 9/2014 Glaspell ..... B25B 21/00 29/407.04
2017/0028521 A1* 2/2017 Yamamoto ..... B25B 23/147
(Continued)

FOREIGN PATENT DOCUMENTS

DE 102008004572 A1 7/2009
DE 202012104427 U1 1/2013
DE 102012205716 A1 10/2013
(Continued)

OTHER PUBLICATIONS

Office Action issued in counterpart German patent application No. 10 2020 204 894.0, dated Aug. 4, 2021.

*Primary Examiner* — Andrew M Tecco
*Assistant Examiner* — Jacob A Smith
(74) *Attorney, Agent, or Firm* — Greer, Burns & Crain, Ltd.

(57) ABSTRACT

A screwdriver is connected to an electric power supply, and rotates a mounted bit to tighten a screw. The screwdriver includes a camera, an image information recording section, a basic information registration section, a determination section, and an LED unit. The camera captures the screw to be tightened or surroundings of a threaded hole in which the screw is to be tightened. The recording section records an image captured by the camera. The registration section registers beforehand image information, which has been acquired by capturing with the camera an image of the surroundings of the threaded hole, as basic information. The
(Continued)

determination section determines whether or not new image information, which has been newly acquired by capturing an image of the surroundings of the threaded hole with the camera, coincides with the basic information. The LED unit notifies a result of determination by the determination section.

13 Claims, 14 Drawing Sheets

(56) References Cited

U.S. PATENT DOCUMENTS

2019/0294138 A1* 9/2019 Dobashi ..... B25B 23/14

FOREIGN PATENT DOCUMENTS

| | | | | | |
|---|---|---|---|---|---|
| DE | 102015103941 | A1 | | 9/2016 | |
| JP | 2009202295 | A | | 9/2009 | |
| JP | 5149035 | B2 | | 2/2013 | |
| JP | 2015110254 | A | * | 2/2015 | ..... B25B 23/15 |
| JP | 2015110254 | A | | 6/2015 | |
| JP | 2017062556 | A | * | 3/2017 | ..... B25B 23/14 |
| JP | 2017062556 | A | * | 3/2017 | ..... B25F 5/00 |
| JP | 2017062556 | A | | 3/2017 | |
| JP | 2019042860 | A | | 3/2019 | |

* cited by examiner

400

| TIGHTENING SEQUENCE | BASIC INFORMATION | TORQUE | SCREW TYPE | IMAGE OF HEAD |
|---|---|---|---|---|
| FIRST | BASIC INFORMATION 1 | TORQUE 1 | SCREW 1 | IMAGE 1 |
| SECOND | BASIC INFORMATION 2 | TORQUE 2 | SCREW 2 | IMAGE 1 |
| ⋮ | ⋮ | ⋮ | ⋮ | ⋮ |
| N-TH | BASIC INFORMATION N | TORQUE N | SCREW N | IMAGE N |

600

| TIGHTENING SEQUENCE | IMAGE |
|---|---|
| FIRST | IMAGE 1 |
| SECOND | IMAGE 2 |
| ⋮ | ⋮ |
| N-TH | IMAGE N |

SCREWDRIVER

BACKGROUND OF THE INVENTION

Field of the Invention

The Present invention relates to a screwdriver such as an electric screw driver or an air screw driver.

Description of the Related Art

In manufacturing premises of diverse industrial articles, screwdrivers are used to perform a variety of screw tightening works (see, for example, JP 5149035 B). This sort of screw tightening work is specified in detail so that types of screws according to a preset rule are tightened with torques, respectively, in a sequence as specified in the rule.

SUMMARY OF THE INVENTION

Concerning screw tightening work, a variety of contrivances have therefore been made including the preparation of a manufacturing procedure manual to prevent operator's mistakes and feeding of screws one after one according to the progress of steps. Nonetheless, it is very irksome and hard to perform precise recording to such an extent as to where each designated screw has been tightened.

In an article that requires high safety and accuracy, such as a vehicle or precision equipment, however, the safety of the article itself may be impaired if even a piece of screw is tightened in a turn different from its turn specified beforehand. Accordingly, there has been a desire to easily and quickly confirm every time whether strews have been tightened in a predetermined sequence.

The present invention therefore has as an object thereof provision of a screwdriver that enables easy confirmation as to whether screws have been tightened in a predetermined sequence.

In accordance with an aspect of the present invention, there is provided a screwdriver having a screwdriver main body and a bit mounted on the screwdriver main body, and configured to be connected to an electric power supply or a compressed air source to rotate the bit for tightening a screw. The screwdriver includes a camera configured to capture an image of the screw to be tightened or a region where the screw is to be tightened, and an image information recording section configured to record an image captured by the camera.

Preferably, the screwdriver further includes a basic information registration section configured to register beforehand image information, which has been acquired by capturing with the camera the image of the region where the screw is to be tightened, as basic information, a determination section configured to determine whether or not new image information, which has been acquired by newly capturing a new image of the region where the screw is to be tightened, coincides with the basic information, and a notification section that notifies a result of the determination by the determination section.

Preferably, the basic information registration section is configured to register, in association with the basic information, a torque to be applied upon tightening the screw at a predetermined location, and the screwdriver further includes a torque adjustment section configured to rotate the bit with the torque registered in association with the basic information determined to coincide by the determination section. Preferably, the image information recording section is configured to record a movie or periodically captured images.

Preferably, the basic information registration section is configured to register the basic information in association with a turn in which the screw is to be tightened, and the determination section includes a tightening sequence determination section that determines whether the new image information determined to coincide by the determination section conforms to the registered turn. Preferably, the screwdriver further includes an information transmission section configured to transmit the image information or a result of determination by the determination section.

The present invention can bring about an advantageous effect that it enables to easily confirm whether screws have been tightened in a predetermined sequence.

The above and other objects, features and advantages of the present invention and the manner of realizing them will become more apparent, and the invention itself will best be understood from a study of the following description and appended claims with reference to the attached drawings depicting or illustrating preferred embodiments of the invention.

DESCRIPTION QF THE DRAWINGS

DETAILED DESCRIPTION OF THE PREFERRED EMBODIMENTS

With reference to the drawings, a description will be made in detail regarding embodiments of the present invention. However, the present invention shall not be limited by details that will be described in the following embodiments. The elements of configurations that will hereinafter be described include those readily conceivable to persons skilled in the art and substantially the same ones. Further, the configurations that will hereinafter be described can be combined appropriately. Furthermore, various omissions, replacements and modifications of configurations can be made without departing from the spirit of the present invention.

First Embodiment

Figure 1:
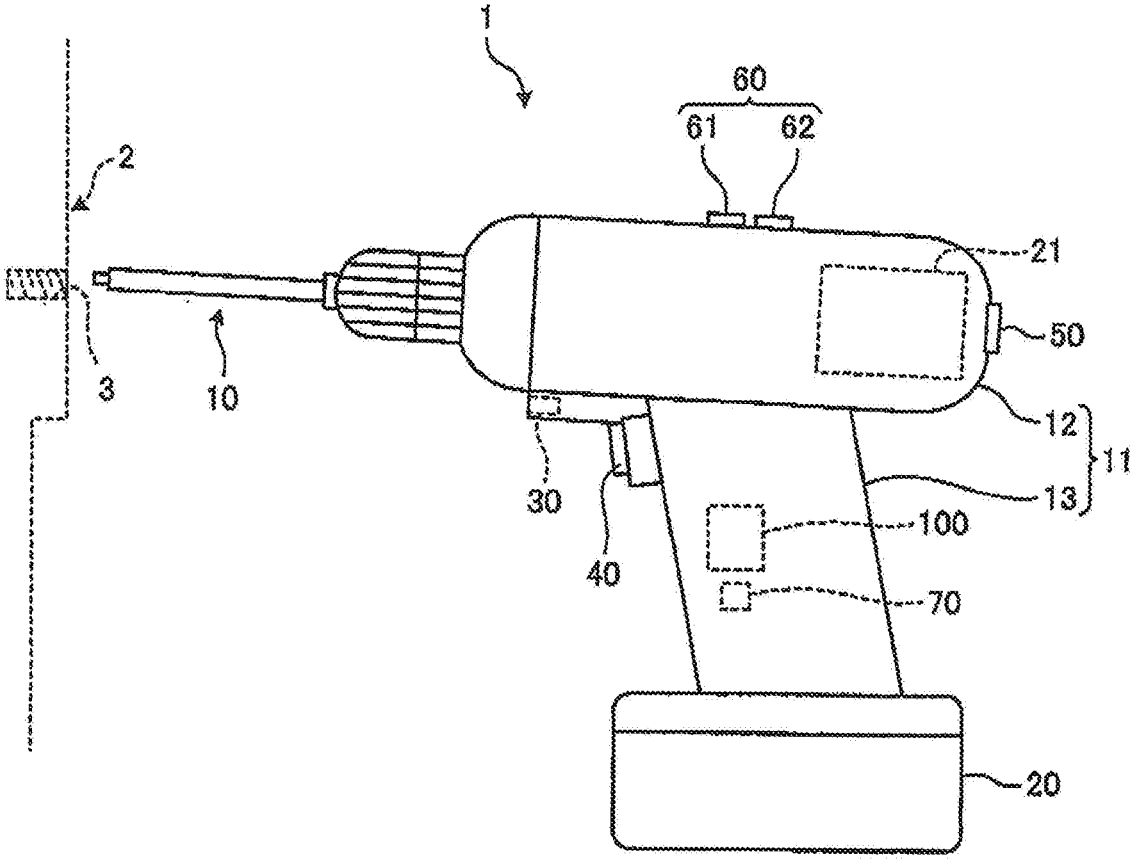
FIG. 1 is a side view depicting a configuration example of a screwdriver according to a first embodiment.
Figure 2A:
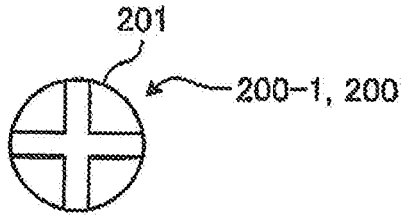
FIG. 2A is a plan view depicting a screw to be tightened by the screwdriver depicted in FIG. 1.
Figure 2B:
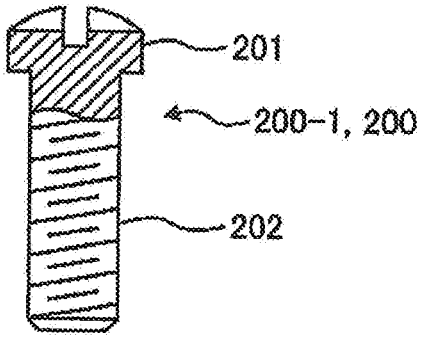
FIG. 2B is a partially cross-sectional side view of the screw in FIG. 2A.
Figure 3A:
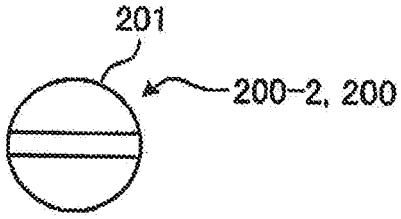
FIG. 3A is a plan view depicting another screw to be tightened by the screwdriver depicted in FIG. 1.
Figure 3B:
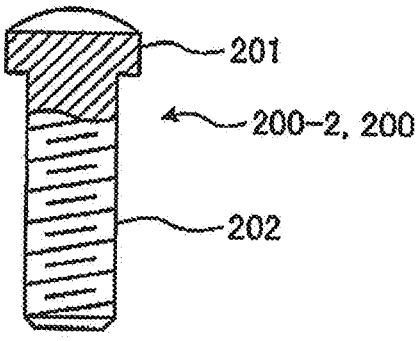
FIG. 3B is a partially cross-sectional side view of the screw in FIG. 3A.
Figure 4A:
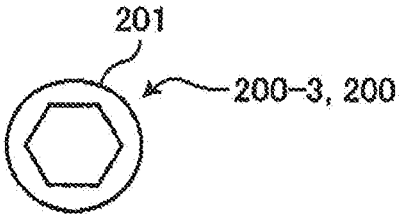
FIG. 4A is a plan view depicting a further screw to be tightened by the screwdriver depicted in FIG. 1.
Figure 4B:
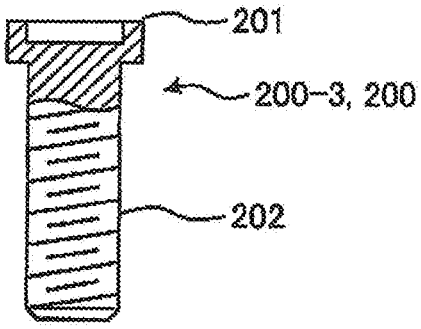
FIG. 4B is a partially cross-sectional side view of the screw in FIG. 4A.
Figure 5A:
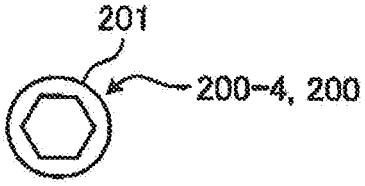
FIG. 5A is a plan view depicting a still further screw to be tightened by the screwdriver depicted in FIG. 1.
Figure 5B:
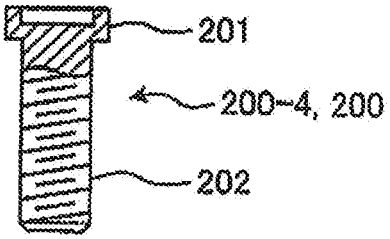
FIG. 5B is a partially cross-sectional side view of the screw in FIG. 5A.

A screwdriver 1 according to a first embodiment as depicted in FIG. 1 is a tool including a bit 10 mounted corresponding to one of screws 200-1, 200-2, 200-3 and 200-4, which are depicted in FIGS. 2A to 5B and are to be tightened, so that the screw 200-1, 200-2, 200-3 or 200-4 is tightened in a threaded hole 3 of an industrial article 2 by rotating the bit 10 about its axis. The screws 200-1, 200-2, 200-3 and 200-4 are made from a metal having ferromagnetic properties, and as depicted in FIGS. 2A to 5B, each include a head 201 to be mounted on a tip end portion of the bit 10 and a threaded portion 202 to be inserted through rotation into the threaded hole 3. The head 201 and the threaded portion 202 are integrated together. In the first embodiment, the bit 10 is made from a permanent magnet at least at the tip end portion thereof, whereby the screw 200-1, 200-2, 200-3 or 200-4 can be magnetically attracted and held on the tip end portion. In the first embodiment, the screws 200-1, 200-2, 200-3 and 200-4 are made from the ferromagnetic material as described above. In the present invention, however, it is not essential to make them from such a ferromagnetic material.

In this specification, the reference numerals 200-1, 200-2, 200-3 and 200-4 will hereinafter be used when the screws 200-1, 200-2, 200-3 and 200-4 are distinguished from one another, while reference numeral 200 will hereinafter be used when the screws 200-1, 200-2, 200-3 and 200-4 are not distinguished from one another. In the first embodiment, the industrial article 2 includes a plurality of threaded holes 3 into which the screws 200 are to be tightened, and the sequence in which the screws 200 are to be tightened into the threaded holes 3 is specified beforehand. For each of the threaded holes 3, the type of the screw 200 to be tightened and a torque (rotary torque) to be applied upon tightening the screw 200 are specified beforehand.

The screwdriver 1 is a so-called electric screwdriver, and specifically, the screwdriver 1 is connected to a battery 20 as an electric power supply, and by electric power supplied from the battery 20, a motor 21 rotates the bit 10 about its axis. The bit 1 which corresponds to the screw 200 to be tightened, is mounted on the screwdriver 1. By changing the bit 10 to be mounted-, the screwdriver 1 can tighten the various screws 200-1, 200-2, 200-3 and 200-4, which are depicted in FIGS. 2, 3, 4 and 5, into the threaded holes 3 of the industrial article 2. In this embodiment, the screwdriver 1 is connected to the battery 20 as the power supply. In the present invention, however, the screwdriver 1 is not limited to being connected to the battery 20 but may be connected to a commercial power supply (alternate current power supply).

As depicted in FIG. 1, the screwdriver 1 has the bit 20 mounted thereon, and includes a tool main body 11 and the above-mentioned motor 21. The tool main body 11 makes up an outer shell of the screwdriver 1. The tool main body 11 includes a screwdriver main body 12 and a grip portion 13. Specifically, the bit 10 is mounted on the screwdriver main body 12, and the motor 21 is accommodated in the screwdriver main body 12. The grip portion 13 is arranged contiguously with the screwdriver main body 12, and can be grasped by an operator. In the first embodiment, the battery 20 is fitted on the grip portion 13.

Figure 6:
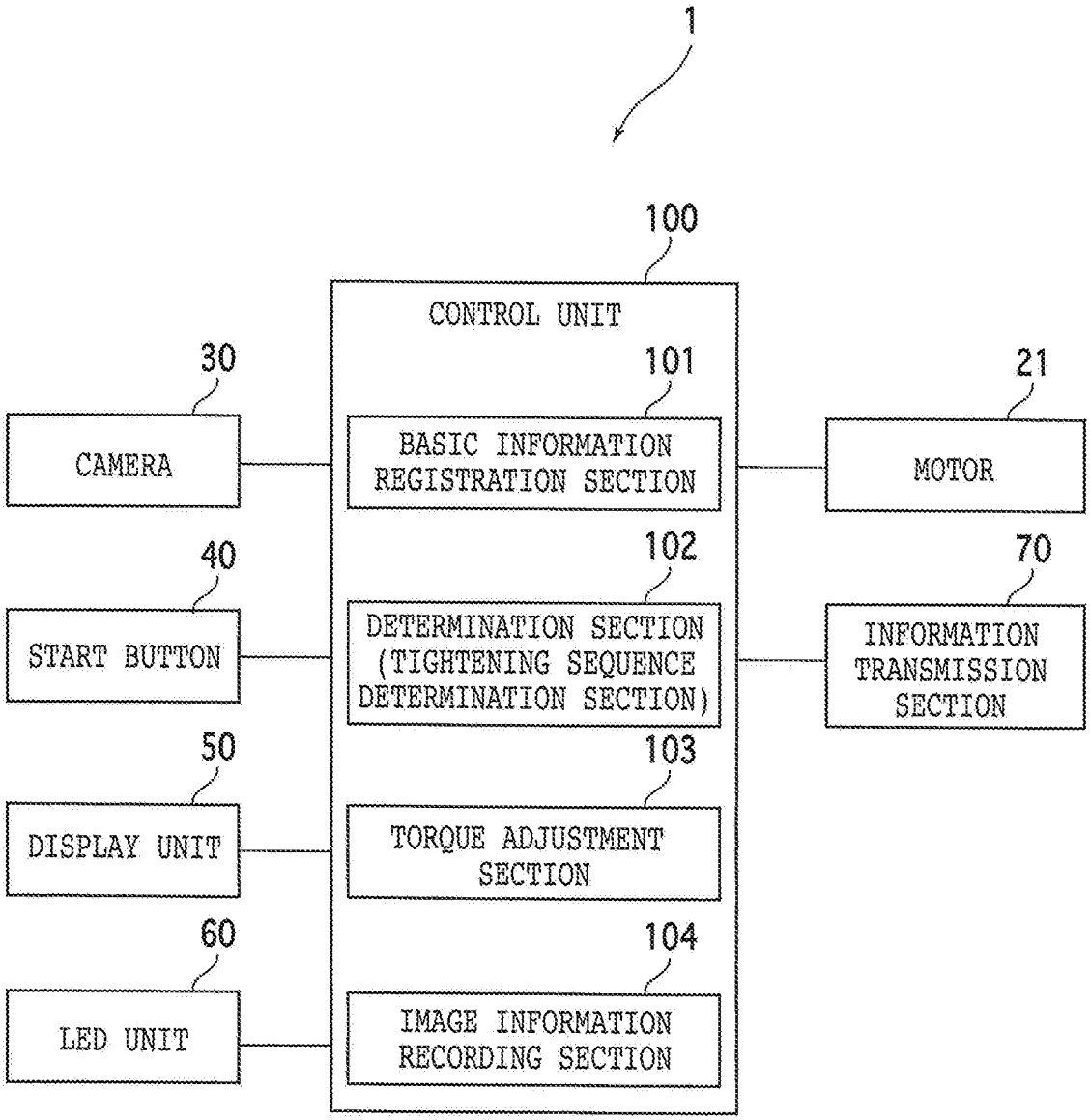
FIG. 6 is a block diagram illustrating a configuration of the screwdriver depicted in FIG. 1.
Figure 7:
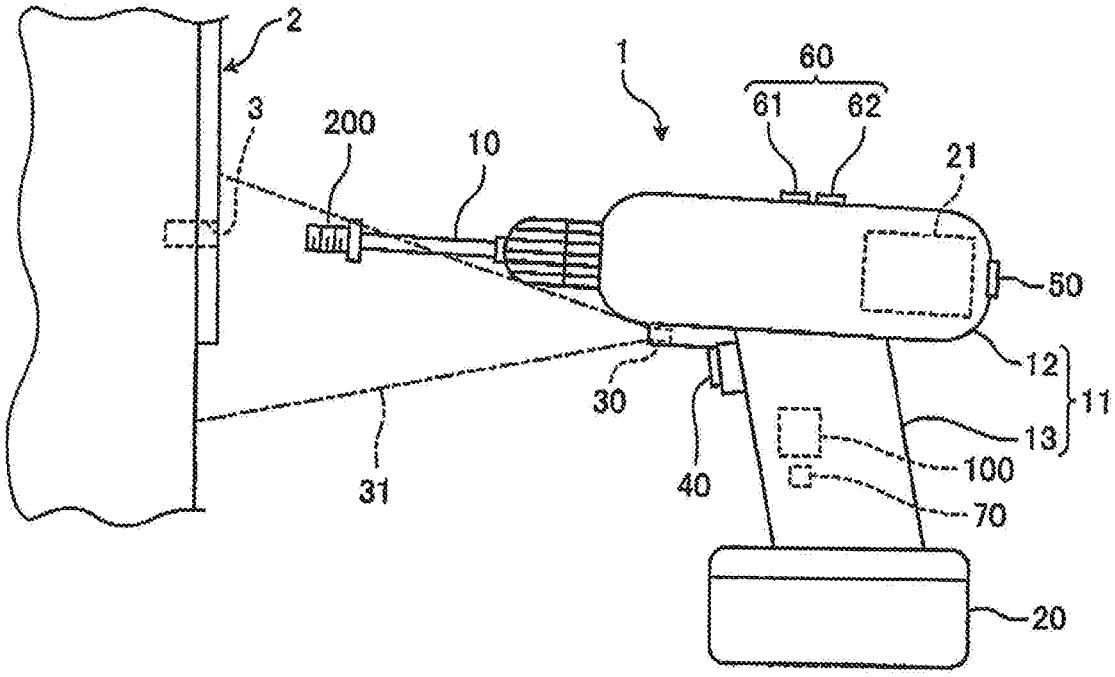
FIG. 7 is a side view depicting a field vision or the like of a camera in the screwdriver depicted in FIG. 1.

As depicted in FIGS. 1 and 6, the screwdriver 1 also includes a camera 30, a start button 40, a display unit 50, a light emitting diode (LED) unit 60, an information transmission section 70, and a control unit 100. As depicted in FIG. 7, the camera 30 has a field of vision 31 that can capture an image of the tip end portion of the bit 10, the screw 200 held on the tip end portion of the bit 10 and to be tightened into the threaded hole 3, and the threaded hole 3 of the industrial article 2 into which the screw 200 is to be tightened, and surroundings of the threaded hole 3, the surroundings being a region where the screw 200 is to be tightened. In the first embodiment, the camera 30 can capture an image of the screw 200 to be tightened and the surroundings of the threaded hole 3 as the region where the screw 200 is to be tightened. In the present invention, however, it is sufficient if the camera 30 can capture an image of the screw 200 to be tightened or the surroundings of the threaded hole 3, the surroundings being the region where the screw 200 is to be tightened. In the present invention, it is not absolutely required for the camera 30 to be able to capture an image of the screw 200 during tightening.

In the first embodiment, the camera 30 is attached to the screwdriver main body 12 of the tool main body 11. The field of vision 31 of the camera 30 is set to permit capturing an image of the tip end portion of the bit 10, the screw 200 held on the tip end portion of the bit 10, the threaded hole 3 of the industrial article 2 into which the screw 200 is to be tightened, and the surroundings of the threaded hole 3. The camera 30 includes an imaging device, which is, for example, a charge-coupled device (CCD) imaging device, or a complementary metal-oxide semiconductor (CMOS) imaging device. The camera 30 outputs the captured and acquired image to the control unit 100.

When operated by the operator, the start button 40 drives the motor 21 to rotate the bit 10 about its axis. In the first embodiment, the start button 40 is arranged on the grip portion 13 so as to be pressed and operable by the operator. When pressed and operated, the start button 40 outputs a signal toward the control unit 100 such that the motor 21 is driven to rotate the bit 10 about its axis.

The display unit 50 displays an image or the like captured by the camera 30, and is configured of a liquid crystal display device or the like in the first embodiment. The display device 50 is disposed on an outer surface of the tool main body 11, and in the first embodiment, is attached to a proximal end portion of the tool main body 11, the proximal end portion being the screwdriver main body 12 on a side remote from the bit 10.

The LED unit 60 includes at least one light emitting diode (LED), and in the first embodiment, includes two LEDs 61 and 62 that emit light of colors different from each other. The LEDs 61 and 62 are disposed on the outer surface of the tool main body 11, and in the first embodiment, are attached to a longitudinally central portion of the screwdriver main body 12. The LEDs 61 and 62 are disposed at an interval therebetween along the longitudinal direction of the screwdriver main body 12, the one LED 61 on a side closer to the bit 10 emits blue light, and the other LED 62 on a side remote from the bit 10 emits red light.

The information transmission section 70 is a wireless communication device which is wirelessly connected for information communication with external electrical equipment. The information transmission section 70 transmits information, which has been outputted from the control unit 100, toward the external electrical equipment.

The control unit 100 controls the individual units and sections of the screwdriver 1, so that the screwdriver 1 performs an operation to tighten the screw 200. The control unit 100 is a computer including a logic processing unit having a microprocessor such as a central processing unit (CPU), a storage device having a memory such as a read only memory (ROM) or a random access memory (RAM), and an input/output interface device. The logic processing unit of the control unit 100 performs logic processing in accordance with a computer program stored in the storage device, whereby control signals are outputted to the respective units and sections of the screwdriver 1 via the input/output interface device to control the screwdriver 1.

Figures 8, 9:
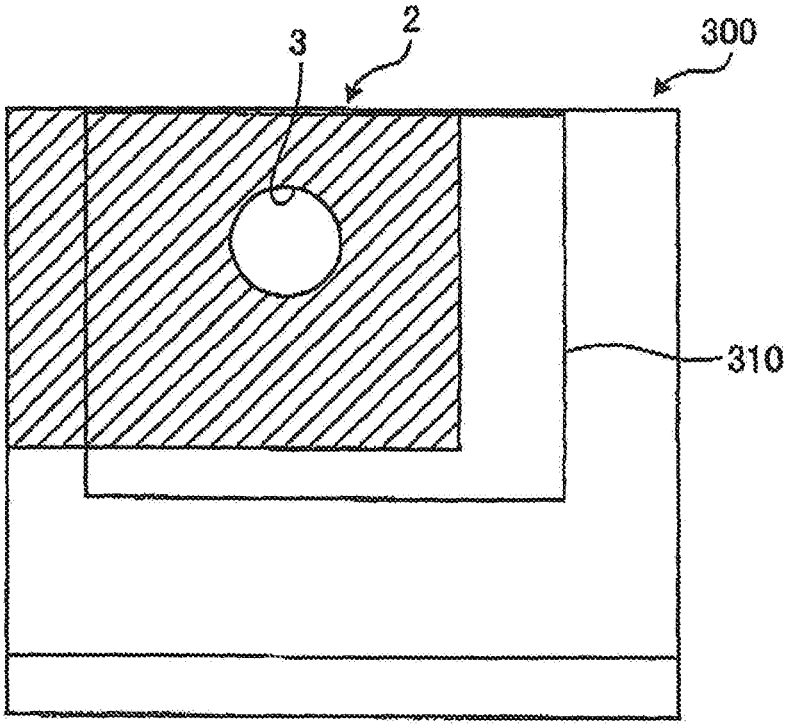
FIG. 8 is a table indicating an example of information to be registered in a basic information registration section of a control unit in the screwdriver depicted in FIG. 1.
FIG. 9 is a view presenting an example of basic information in the information illustrated in FIG. 8.
Figure 10:
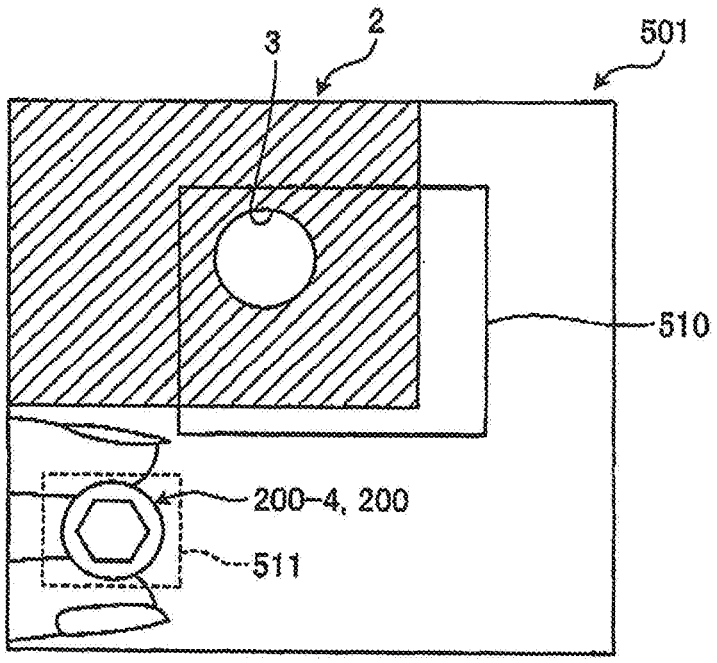
FIG. 10 is a view presenting an example of new image information acquired by capturing an image with the camera in the screwdriver depicted in FIG. 1.
Figure 11:
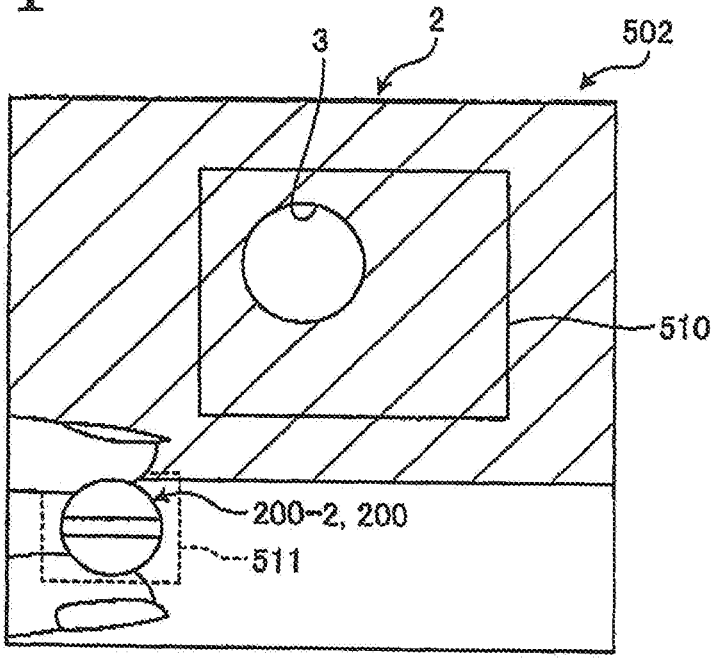
FIG. 11 is a view presenting another example of the new image information acquired by capturing the image with the camera in the screwdriver depicted in FIG. 1.
Figure 12:
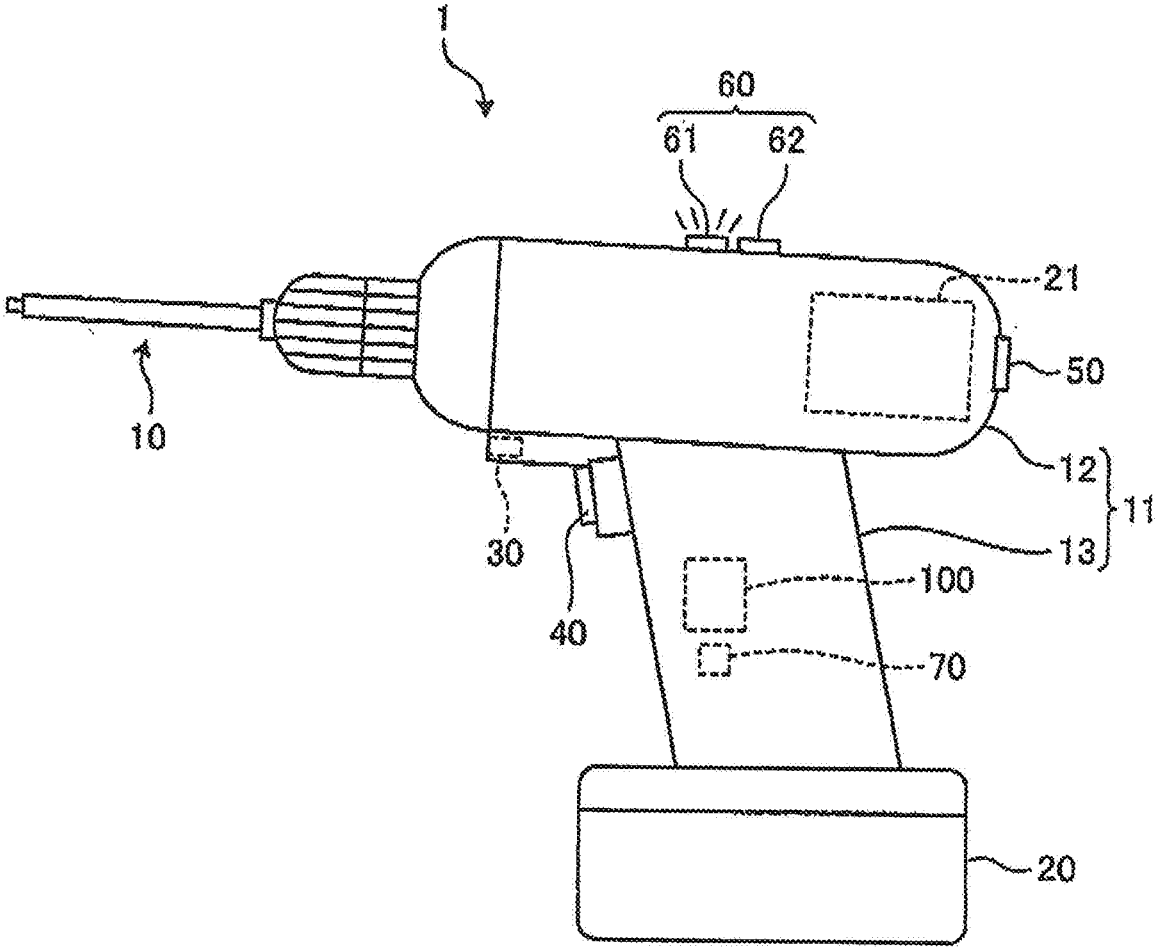
FIG. 12 is a side view depicting a state when the basic information regarding the screwdriver depicted in FIG. 1 and the new image information have been determined to coincide.
Figures 13, 14:
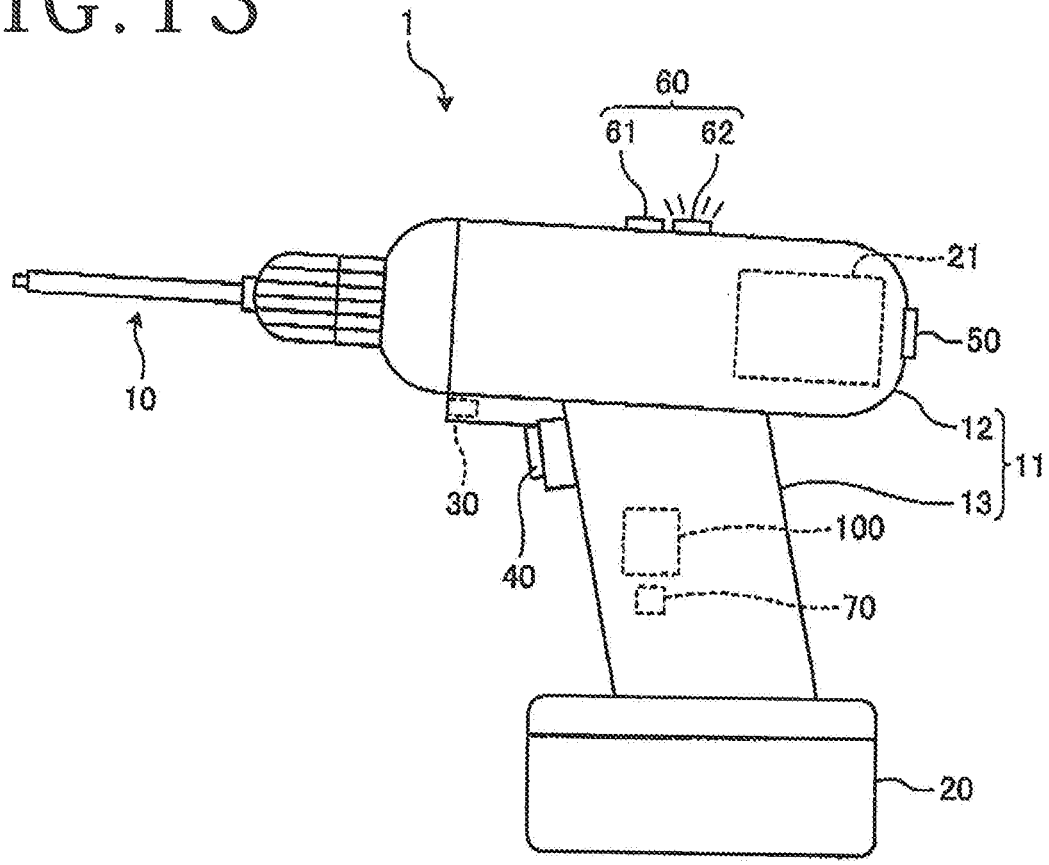
FIG. 13 is a side view depicting a state when the basic information regarding the screwdriver depicted in FIG. 1 and the new image information have been determined not to coincide.
FIG. 14 is a table indicating an example of information to be recorded in an image information recording section of the control unit in the screwdriver depicted in FIG. 1.
Figure 15:
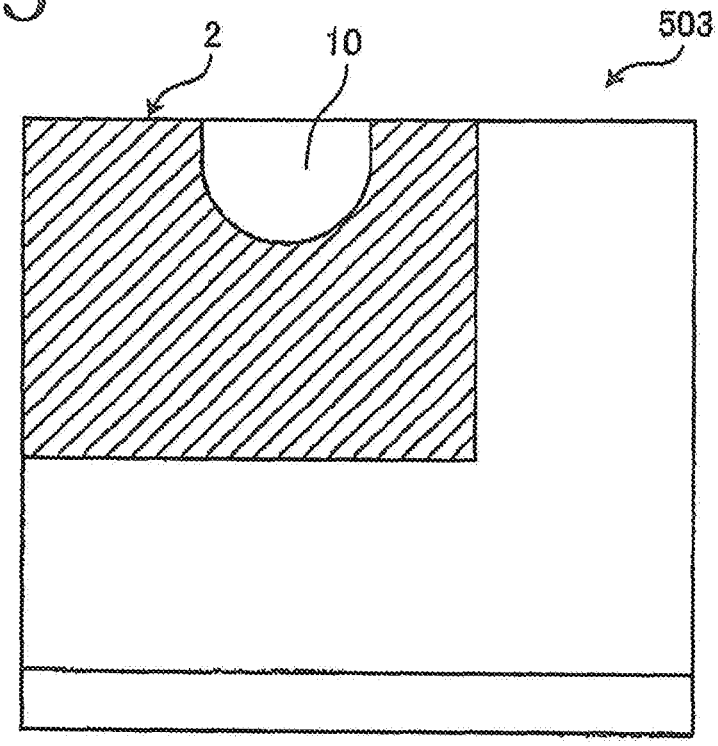
FIG. 15 is a view presenting an example of an image acquired by capturing an image with the camera in the screwdriver depicted in FIG. 1 while a screw is being tightened.

The present specification next describes the control unit 100 on the basis of relevant ones of the attached figures. FIG. 8 is a table indicating an example of information to be registered in a basic information registration section of a control unit in the screwdriver depicted in FIG. 1. FIG. 9 is a view presenting an example of basic information in the information illustrated in FIG. 8. FIG. 10 is a view presenting an example of new image information acquired by capturing an image with the camera in the screwdriver depicted in FIG. 1. FIG. 11 is a view presenting another example of the new image information acquired by capturing the image with the camera in the screwdriver depicted in FIG. 1. FIG. 12 is a side view depicting a state when the basic information regarding the screwdriver depicted in FIG. 1 and the new image information have been determined to coincide. FIG. 13 is a side view depicting a state when the basic information regarding the screwdriver depicted in FIG. 1 and the new image information have been determined not to coincide. FIG. 14 is a table indicating an example of information to be recorded in an image information recording section of the control unit in the screwdriver depicted in FIG. 1. FIG. 15 is a view presenting an example of an image acquired by capturing an image with the camera, the screwdriver depicted in FIG. 1 while a screw is being tightened.

As illustrated in FIG. 6, the control unit 100 also includes a basic information registration section 101, a determination section 102 as a tightening sequence determination section, a torque adjustment section 103, and an image information recording section 104. The basic information registration section 101 registers beforehand, as basic information 300 (for example, as presented in FIG. 9), image information acquired by capturing images of the threaded holes 3 and surroundings of the threaded holes 3, as regions where the screws 200 for the industrial article 2 are to be tightened, beforehand with the camera 30. The basic information 300 is obtained by capturing an image of each threaded hole 3 and the surroundings of the threaded hole 3 with the camera 30 before the screwdriver 1 tightens the screw 200 into the threaded hole 3.

In the first embodiment, information 400 presented in FIG. 8, for example, plural pieces of basic information 300 are registered in the basic information registration section 101. In the basic information registration section 101, a sequence in which screws 200 are to be tightened, the plural pieces of basic information 300, that is, image information regarding respective threaded holes 3 in the tightening sequence and surroundings of the threaded holes 3, torques to be applied upon tightening the screws 200 into the respective threaded holes 3 as predetermined locations, and types of the screws 200 to be tightened into the respective threaded holes 3 are registered in association with one another for every threaded hole 3 in the information 400 as presented in FIG. 8. Therefore, in the basic information registration section 101, the plural pieces of basic information 300 are registered corresponding to the sequence in which the screws 200 are to be tightened into the threaded holes 3, and the torques to be applied upon tightening the screws 200 into the threaded holes 3 are registered corresponding to the Plural pieces of basic information 300. In the first embodiment, the images acquired by imaging the heads 201 of the screws 200 are also registered, in addition to the types of the screws 200, in association with the sequence, in which the screws 200 are to be tightened, and the like for each threaded hole 3 in the information 400 in the basic information registration section 101.

Shortly before the screwdriver 1 tightens the screw 200 into the threaded hole 3, the determination section 102 determines whether or not a new image information 501 or 502 (an example of which is presented in FIG. 10 or 11), which has been acquired by newly imaging the threaded hole 3 and the surroundings of the threaded hole 3 with the camera 30, coincide with the corresponding piece of basic information 300. Described specifically, when, shortly before the screwdriver 1 tightens the screw 200 into each threaded hole 3, the start button 40 is operated by the operator and the bit 10 is rotated, the camera 30 captures a movie or captures still images periodically (every constant period of time), and the movie or one of the still images, in which the threaded hole 3 is captured, is acquired as the above-mentioned new image information 501 or 502. In the present invention, the start of capturing an image by the camera 30 may also be triggered through a start/stop button, which is arranged exclusively for image capturing, instead of an operation of the start button 40 for the rotation of the bit 10.

By referring to the information 400 presented in FIG. 8 and collating the basic information 300, which corresponds to the next tightening operation in the sequence, with the new image information 501 or 502, the determination section 102 determines whether or not they coincide. Described specifically, the determination section 102 performs a normalized correlation such as pattern matching between the basic information 300 and the new image information 501 or 502. If a correlation value is equal to or greater than a predetermined value, the determination section 102 determines that the basic information 300 and the new image information 501 or 502 coincide with each other. If the correlation value is smaller than the predetermined value, on the other hand, the determination section 102 determines that the basic information 300 and the new image information 501 or 502 do not coincide with each other.

In the first embodiment, the determination section 102, upon performing the normalized correlation, extracts the basic information 300 and the surroundings of the threaded hole 3 in the new information 501 and 502 as characterizing parts 310 and 510 (which are surrounded by a rectangle in FIGS. 9, 10 and 11), and determines whether or not the characterizing parts 310 and 510 coincide with each other. In the manner described above, the determination section 102 determines whether the new image information 501 and 502, which have been determined to coincide with the basic information 300, conform to the sequence that indicates the screw 200 registered in the basic information registration section 101.

The determination section 102 also extracts a region 511 (which is surrounded by dashed lines in FIG. 10 or 11), which contains the head 201 of the screw 200, from the new image information 501 or 502. The determination section 102 collates the image of the head 201 of the screw 200, which corresponds to the next tightening operation of the screw 200 as acquired by referring to the information 400 presented in FIG. 8, with the region 511 containing the head 201 of the screw 200 as extracted from the new image information 501 or 502, and determines whether or not they coincide with each other. Upon collating the region 511 and the image of the head 201 of the screw 200 in the information 400 with each other, the determination section 102 performs the collation in a similar manner as in the collation between the basic information 300 and the new image information 501 or 502.

Once the new image information 501 or 502 has been acquired, the determination section 102 outputs the acquired image information to the display unit 50 to display the new image information 501 or 502 on the display unit 50.

Now assume, for example, that the determination section 102 has determined through collation between the basic information 300 presented in FIG. 9 and the new image information 501 presented in FIG. 10 that they coincide with each other in the first embodiment. Also assume that the determination section 102 has determined through collation between an image of the head 201 of the screw 200, which corresponds to the next tightening operation in the information 400, and the region 511, which contains the head 201 of the screw 200, as extracted from the new image information. 501 that they coincide with each other. As depicted in FIG. 12, the control unit 100 then turns on the one LED 61 in the LED unit 60, which is on a side closer to the bit 10, and turns off the other LED 62.

On the other hand, assume that the determination section 102 has determined through collation between the basic information 300 presented in FIG. 9 and the new image information 502 presented in FIG. 11 that they do not coincide with each other. As depicted in FIG. 13, the control unit 100 then turns on the other LED 62 in the LED unit 60, which is on a side remote from the bit 10, and turns off the one LED 61. In this manner, the LED unit 60 switches the LED, which is to be turned on, between the LED 61 and the LED 62, and performs a function of a notification section that notifies the operator of a result of determination by the determination section 102.

The torque adjustment section 103 controls the motor 21 such that the bit 10 is rotated with the torque registered in association with the basic information 300, which the determination section 102 has determined to coincide, in the information 400. If the determination section 102 determines in the first embodiment that the basic information 300 presented in FIG. 9 and the new image information 501 presented FIG. 10 coincide with each other and that the image of the head 201 of the screw 200, which corresponds to the next tightening operation, and the region 511, which contains the head 201 of the screw, as extracted from the new image information 501 coincide with each other, the control unit 100 reads the torque associated with the basic information 300, which has been determined to coincide, with reference to the information 400 presented in FIG. 8. The torque adjustment section 103 controls the motor 21 to rotate the bit 10 with the torque having been read.

The image information recording section 104 records an image captured by the camera 30 while the screwdriver 1 is tightening the screw 200. As presented in FIG. 15, the image information recording section 104 registers, as tightening information 600, the operation, in which the screwdriver 1 tightened the screws 200, and the images, which was captured by the camera 30 during the tightening of the screws 200, for every threaded hole 3 in association with each other in the first embodiment. In the first embodiment, the image information recording section 104 records the new image information 501 or 502, which is the still image presented in FIG. 10 or 11, and an image 503 (a part of which is presented in FIG. 15), which is formed of a movie captured or a plurality of still images captured periodically until elapse of a predetermined time from a pressing operation of the start button 40, together as an image in the tightening information 600.

If the determination section 102 determines in the first embodiment that the basic information 300 and the new image information 501 coincide with each other and that the image of the head 201 of the screw 200, which corresponds to the next tightening operation, and the region 511, which contains the head 201 of the screw 200, as extracted from the new image information 501 coincide with each other, the image information recording section 104 records the image. However, the present invention is not limited to the foregoing, but not only including the case that they coincide but also including the case that they do not coincide, the movie or still images from the pressing operation of the start button 40 until the elapse of the predetermined time after the end of the pressing operation may be recorded as an image.

The function of the basic information registration section 101 is realized through storage of the information 400, which is presented in FIG. 8, in a storage device. The functions of the determination section 102 and the torque adjustment section 103 are realized by outputting control signals for the control of the screwdriver 1 to the respective units and sections of the screwdriver 1 via the input/output interface device through execution of a computer program, which is stored in the storage device, by the logic processing unit. Further, the function of the image information recording section 104 is realized through recording of the tightening information 600, which is presented in FIG. 14, in the storage device.

Before the above-mentioned screwdriver 1 tightens the screws 200 in the threaded holes 3 of the industrial article 2, respectively, the information 400 presented in FIG. 8 is registered in the basic information registration section 101. Upon tightening, into each of the threaded holes of the industrial article 2, the corresponding screw 200 by the screwdriver 1, the start button 40 is pressed and operated by the operator. Then, the camera 30 captures a movie or captures still images periodically (every constant period of time), whereby the determination section 102 acquires the new image information 501 or 502. With reference to the information 400 presented in FIG. 8, the determination section 102 collates the basic information 300, which corresponds to the first tightening operation in the predetermined sequence, and the new image information 501 or 502 with each other, and determines whether or not they coincide with each other. A result of the determination is notified by turning on the LED 61 or 62 in the LED unit 60. If the basic information 300 and the new information 501 or 502 have been determined to coincide with each other, the LED 61 is turned on, and the screwdriver 1 rotates the bit 10 about its axis with the torque corresponding to the first tightening operation in the predetermined sequence, so that the screw 200 is tightened into the threaded hole 3.

As the tightening information 600, the image information recording section 104 records the image, which the camera 30 captured during the tightening of the screw 200, in association with information regarding which one of the first to n-th tightening operations the screwdriver 1 tightened the screw 200. After completion of the tightening of the screw 200 in the threaded hole 3 as the target of the first tightening operation, the screwdriver 1 tightens, into another threaded hole 3 as a target of the next tightening operation, the corresponding screw 200. By these operator's tightening operations, the screwdriver 1 therefore tightens, in the threaded holes 3 of the industrial article 2, all the corresponding screws 200 in the predetermined sequence.

The screwdriver 1 according to the above-described first embodiment includes the camera 30 configured to capture images of the respective threaded holes 3 and the surroundings of the threaded holes 3, and the image information recording section 104 records the images, which have been captured by the camera 30, as tightening information 600. The screwdriver 1 therefore brings about an advantage that checking of the images in the tightening information 600 enables easy confirmation as to whether the screws 200 have been tightened in the predetermined sequence.

The images and the tightening sequence of the screws 200 are associated with each other in the tightening information 600. Therefore, the screwdriver 1 also enables to easily confirm the sequence in which the screws were tightened.

The basic information registration section 101 registers beforehand the information 400 presented in FIG. 8, the determination section 102 collates each new image information 501 or 502 with the corresponding piece of information 300 in the information 400, and the LED unit 60 notifies the result of the determination. Therefore, the screwdriver 1 also enables the operator to recognize, during the tightening operation, whether or not the individual screws 200 are being tightened in the predetermined sequence, in other words, in the sequence as specified beforehand.

In the information 400 registered by the basic information registration section 101, the tightening sequence, which specifies the screws 200, and the torques are associated with each other. The screwdriver 1 hence enables to tighten with the torques, which are specified in the information 400 presented in FIG. 8, upon tightening the individual screws 200-1, 200-2, 200-3, and 200-4.

Second Embodiment

Figure 16:
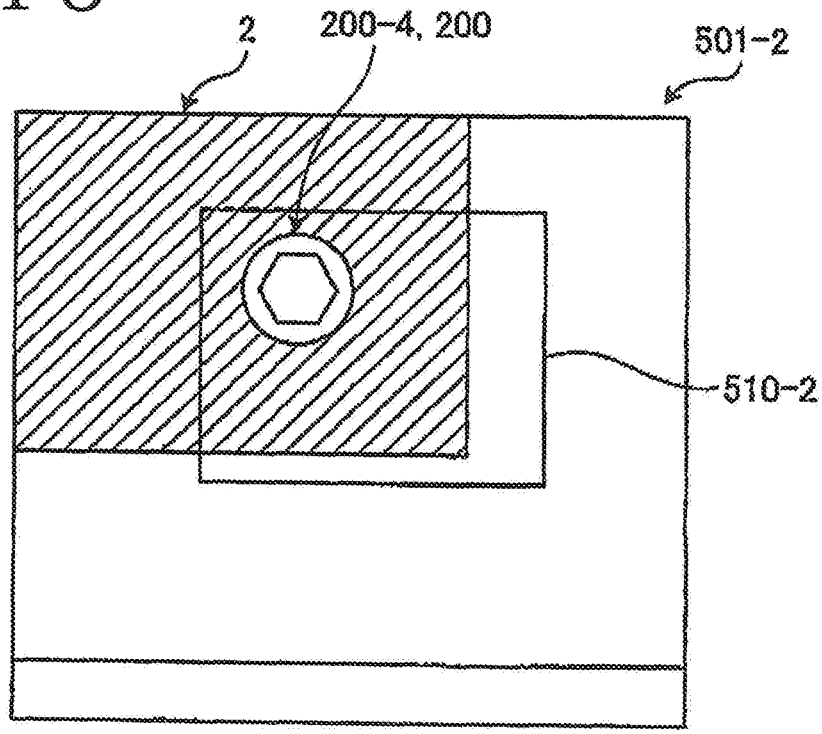
FIG. 16 is a view presenting an example of new image information acquired by capturing an image with a camera in a screwdriver according to a second embodiment.

A screwdriver according to a second embodiment of the present invention will be described based on the relevant one of the attached figures. FIG. 16 is a view presenting an example of new image information acquired by capturing an image with the camera in the screwdriver according to the second embodiment. In FIG. 16, the same elements as in the first embodiment are denoted by the same reference numerals, and their description is omitted.

The screwdriver 1 according to the second embodiment is the same as that of the first embodiment except that the determination section 102 acquires, after tightening in each threaded hole 3 the corresponding screw 200, new image information 501-2 (see FIG. 16) by newly capturing an image of the threaded hole 3 and the surroundings of the threaded hole 3 with the camera 30, and determines whether or not the new image information 501-2 presented in FIG. 16 coincides with the corresponding piece of basic information 300. In the second embodiment, the determination section 102 determines, upon pattern matching, whether or not the characterizing part 310 in the corresponding piece of basic information 300 and the image of the head 201 of the corresponding screw 200 in the information 400 presented in FIG. 8 coincide with a characterizing part 510-2 of the surroundings of the threaded hole 3 in the new image information 501-2.

The screwdriver 1 according to the second embodiment includes the camera 30 configured to capture images of the respective threaded holes 3 and the surroundings of the threaded holes 3, and the image information recording section 104 records the images, which have been captured by the camera 30, as tightening information 600. As in the first embodiment, the screwdriver 1 therefore brings about the advantage that checking of the images in the tightening information 600 enables easy confirmation as to whether the screws 200 have been tightened in the predetermined sequence.

After tightening, in each threaded hole 3, the corresponding screw 200, the determination section 102 acquires the new image information 501-2 and determines whether or not the new image information 501-2 coincides with the corresponding piece of basic information 300, and the LED 61 or 62 notifies the result of the determination. Hence, the screwdriver 1 according to the second embodiment also enables the operator to recognize whether or nest the individual screws 200 have been tightened in the predetermined sequence, in other words, in the sequence as specified beforehand.

Third Embodiment

Figure 17:
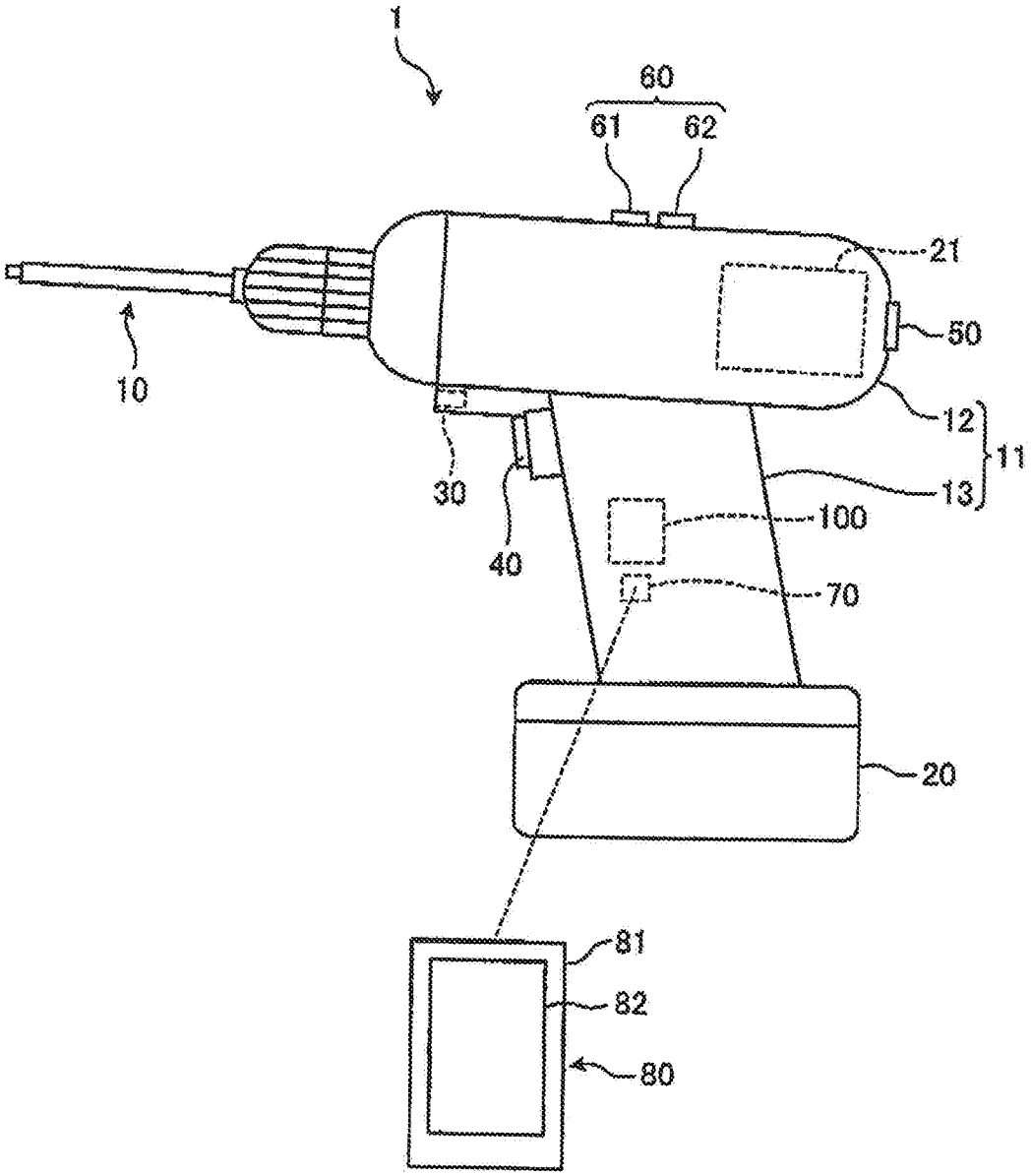
FIG. 17 is a side view depicting a screwdriver according to a third embodiment and a terminal device.
Figure 18:
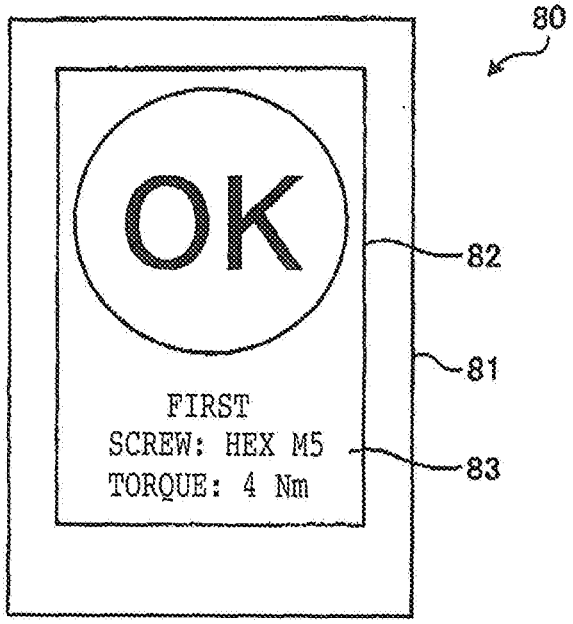
FIG. 18 is a presentation of an example of a result of determination by the determination section as displayed on the terminal device depicted in FIG. 17.
Figure 19:
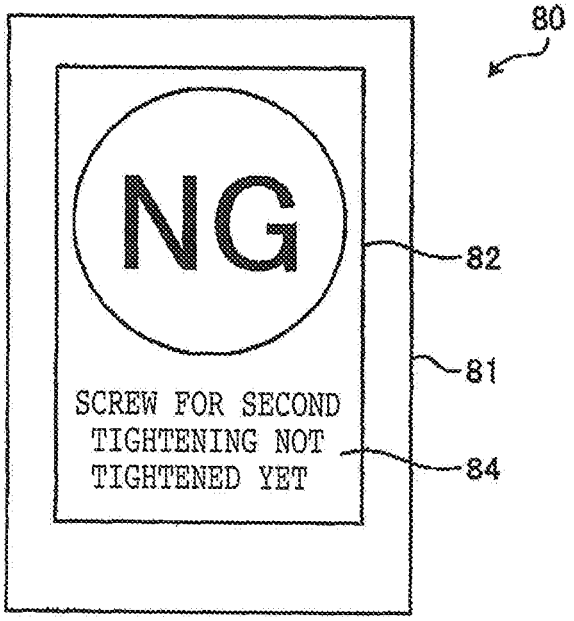
FIG. 19 is a presentation of another example of the result of determination by the determination section as displayed on the terminal device depicted in FIG. 17.
Figure 20:
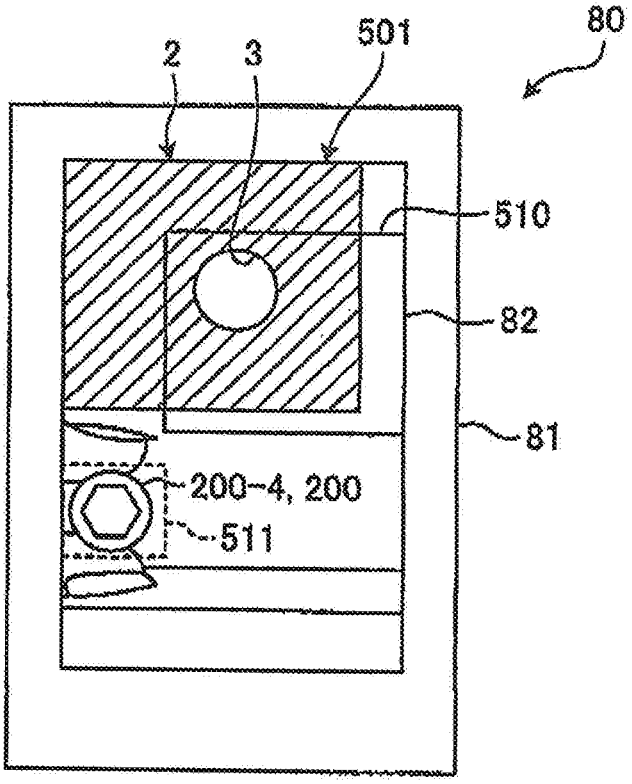
FIG. 20 is a view presenting an example of new image information as displayed on the terminal device depicted in FIG. 17.

A screwdriver according to a third embodiment of the present invention will be described based on the relevant ones of the attached figures. FIG. 17 is a side view depicting the screwdriver according to the third embodiment and the terminal device. FIG. 18 is a presentation of an example of a result of determination by the determination section as displayed on the terminal device depicted in FIG. 17. FIG. 19 is a presentation of another example of the result of determination by the determination section as displayed on the terminal device depicted in FIG. 17. FIG. 20 is a view of an example of new image information as displayed on the terminal device depicted in FIG. 17. In FIGS. 16, 17, 18 and 19, the same elements as in the first embodiment are denoted by the same reference numerals, and their description is omitted.

The screwdriver 1 according to the third embodiment is the same as that of the first embodiment or second embodiment except that in addition to the functions of the above-mentioned first embodiment or second embodiment, the information transmission section 70 also transmits, under control by the control unit 100, the new image information 501, an example of which is presented in FIG. 10, and the result of determination by the determination section 102 to a terminal device 80 depicted in FIG. 17, etc. and the terminal device 80 can display the result of determination by the determination section 102 on the display device 82 as presented in FIG. 18 or FIG. 19 and also that as presented in FIG. 20, the new image information 501 can also be displayed on the display device 82. In the third embodiment, the terminal device 80 therefore performs the function of the notification section that notifies the result of determination by the determination section 102.

The terminal device 80 is a portable terminal that the operator can carry. In a first mode of practice, the terminal device 80 is a tablet or portable computer which as presented or depicted in FIGS. 16, 17, 18 and 19, includes a casing 81, the display device 82, an input device, a wireless communication device, a logic processing unit having a microprocessor such as a CPU, a storage device having a memory such as a ROM or a RAM, and an input/output interface device. The terminal device 80 is not limited to such a tablet or portable computer, insofar as it is electronic equipment that the operator can carry.

The casing 81 accommodates at least the wireless communication device, logic processing unit, storage device and input/output interface device of the terminal device 80. The logic processing unit of the terminal device 80 performs logic processing in accordance with a computer program stored in the storage device, and outputs control signals to the individual units of the terminal device 80 via the input/output interface device to control the terminal device 80. The display device 82 is configured of a liquid crystal display device or the like. The display device 82 displays characters, still images, moving images, marks, and shapes.

The input device receives operation inputs from a user. In the third embodiment, the input device is a touchscreen placed over the display device 82 and is configured of a touchscreen adopting, as a detection system, an electrostatic capacitive system, resistive film system, surface acoustic wave system, ultrasonic system, infrared system, electromagnetic resonance system or load detection system. The wireless communication device is connected for wireless communication of information to the information transmission section 70 of the screwdriver 1.

In the third embodiment, the information transmission section 70 transmits, together with the result of determination by the determination section 102, immediately preceding or subsequent information regarding in which one of the first to n-th tightening operations the screwdriver 1 has tightened or is about to tighten each screw 200, end the fresh image information 501 to the terminal device 80. When the wireless communication device receives the result of determination by the determination section 102 and the new image information 501, the terminal device 80 displays an icon, which presents the result of determination, and another icon, which presents the new image information 501, on the display device 82. If an operation input of one of these icons is received from the operator, the terminal device 80 displays the received icon on the display unit 50.

If the input device receives an operation input of the icon, which presents the result of determination, from the operator, for example, the terminal device 80 displays the result of determination by the determination section 102 on the display device 82 as presented in FIG. 18 or 19. If the result of determination by the determination section 102 is "coincided," the terminal device 80 displays "OK," "message 83," indicating the sequence, the type of the screw 200, and the torque on the display device 82 as presented in FIG. 18. "OK" is a mark indicating coincidence, and "message 83" indicates information regarding in which one of the first to n-th tightening operations the screwdriver 1 has tightened. If the result of determination by the determination section 102 is "not coincided," on the other hand, the terminal device 80 displays "NG" and "message 84" on the display device 82 as presented in FIG. 19. "NG" is a mark indicating non-coincidence, and "message 84" indicates that the screw 200 corresponding to the information regarding in which one of the first to n-th tightening operations the screwdriver 1 has tightened, the information having been received together with the result of determination, has not been tightened yet. If the input device receives an operation input of an icon, which represents the new image information 501, from the operator, the terminal device 80 displays the new image information 501 on the display device 802 as presented in FIG. 20.

In the third embodiment, the terminal device 80 also switches the information, which is to be displayed on the display device 82, between the results of determination by the determination section 102 as presented in FIG. 18 or 19 and the new image information 501 presented in FIG. 20 if the input device receives an operation input of switching the information to be displayed on the display device 82.

The screwdriver 1 according to the third embodiment includes the camera 30 configured to capture images of the respective threaded holes 3 and the surroundings of the threaded holes 3, and the image information recording section 104 records the images, which have been captured by the camera 30 as tightening information 600. As in the first embodiment, the screwdriver 1 therefore brings about the advantageous effect that checking of the images in the tightening information 600 enables easy confirmation as to whether the screws 200 have been tightened in the predetermined sequence.

Via the terminal device 80, the new image information 501 and the result of determination by the determination section 102 can be visually recognized. The screwdriver 1 according to the third embodiment therefore brings about an advantageous effect that during or after the use of the screwdriver 1 by the operator, the user of the terminal device 80 other than the operator of the screwdriver 1 can easily confirm whether the operator is tightening or has tightened the screws 200 in the predetermined sequence.

In the third embodiment, the information transmission section 70 is configured to enable the transmission of the new image information 501, the example of which is presented in FIG. 10, and the result of determination by the determination section 102 to the terminal device 80 and the terminal device 80 is configured to enable the display of both of the new image information 501 and the result of determination by the determination section 102 on the display device 82. In the present invention, however, it is only required that the information transmission section 70 transmits one of the new image information 501, the example of which is presented in FIG. 10, and the result of determination by the determination section 102 to the terminal device 80 and the terminal device 80 displays one of the new image information 501 and the result of determination by the determination section 102 on the display device 82.

Modification

Figure 21:
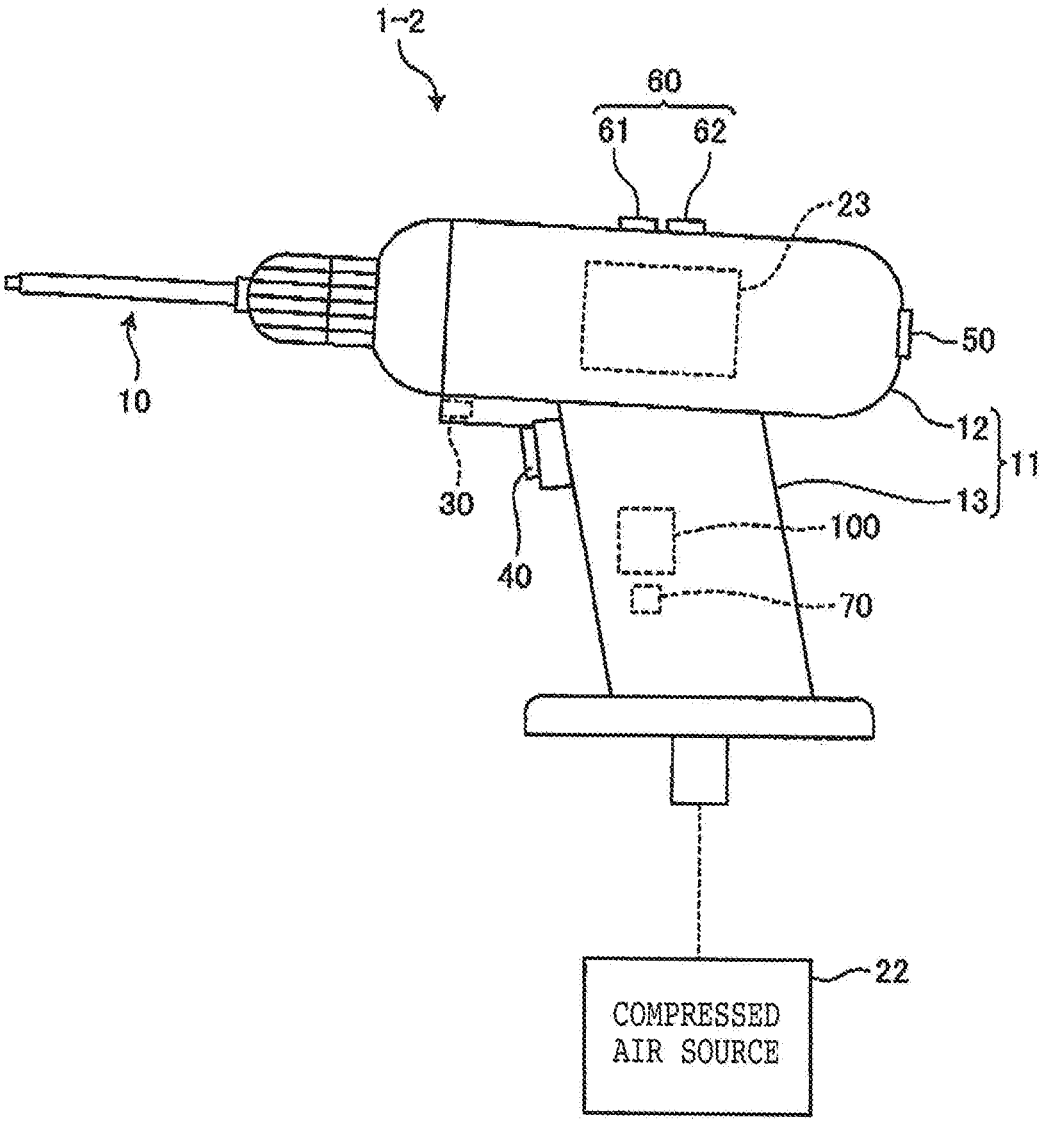
FIG. 21 is a side view depicting a configuration example of a screwdriver according to a modification of the first embodiment, the second embodiment, or the third embodiment.

A screwdriver 1 according to a modification of the first embodiment, second embodiment or third embodiment of the present invention will be described on the basis of relevant one of the attached figures. FIG. 21 is a side view depicting a configuration example of the screwdriver according to the modification of the first embodiment, second embodiment or third embodiment. In FIG. 21, the same elements as in the first embodiment, second embodiment and third embodiment are denoted by the same reference numerals, and their description is omitted.

The screwdriver 1-2 according to the modification is the same as that of the first embodiment, second embodiment or third embodiment except that it is a so-called air screwdriver which includes, instead of the motor 21, a rotor 23 connected to a compressed air source 22 and is configured to rotate the bit 10 about its axis when compressed air is supplied from the compressed air source 22.

The screwdriver 1-2 according to the modification includes the camera 30 configured to capture images of the respective threaded holes 3 and the surroundings of the threaded holes 3, and the image information recording section 104 records the images, which have been captured by the camera 30, as tightening information 600. Similar to the screwdriver 1 of the first embodiment, the screwdriver 1-2 of the modification therefore brings about the advantageous effect that checking of the images in the tightening information 600 enables easy confirmation as to whether the screws 200 have been tightened in the predetermined sequence.

However, the present invention shall net be limited to the above-described embodiments and modification. In other words, the present invention can be practiced with various modifications in a range not departing from the spirit of the present invention. In the above-described embodiments, the plural pieces of basic information 300 are registered in association with the sequence, in which the screws 200 are to be tightened, in the basic information registration section 101. In the present invention, however, only one piece of basic information 300 may be registered, and the sequence in which the plural pieces of basic information 300 are to be registered is not limited to that described in the embodiments. In the present invention, the screwdrivers 1 and 1-2 is required to include at least the camera 30 and the image information recording section 104 without inclusion of the basic information registration section 101, the determination unit 102, and the LED unit 60 as the notification section. In the present invention, the screwdrivers 1 and 1-2 may include a speaker, which generates a sound and notifies coincidence or non-coincidence, as a notification section instead of the LED unit 60.

In the present invention, the screwdrivers 1 and 1-2 may include a light, a laser pointer or the like at an appropriate location to illuminate imaging targets so that each location, an image of which is being captured by the camera 30, can be recognized by a person who is capturing the image. If this is the case, the screwdrivers 1 and 1-2 may omit the display unit 50. In the present invention, it is suited for the screwdrivers 1 and 1-2 that the camera 30 and the control unit 100, which includes CPU and the like, are fixed by a mechanism isolated from vibrations of the screwdrivers 1 and 1-2. In the present invention, the screwdrivers 1 and 1-2 may record, in the storage device of the control unit 100, images captured by the camera 30 during tightening of the screws 200 and torques or the like upon the tightening of the screws 200. In such recording, the images and torques may desirably be recorded together and in association with day/time information.

The present invention is not limited to the details of the above-described preferred embodiments and modification. The scope of the invention is defined by the appended claims and all changes and modifications as fall within the equivalence of the scope of the claims are therefore to be embraced by the invention.

What is claimed is:

1. A screwdriver having a screwdriver main body and a bit mounted on the screwdriver main body, and configured to be connected to an electric power supply or a compressed air source to rotate the bit for tightening a screw, the screwdriver comprising:

a camera configured to capture an image of the screw to be tightened and a region where the screw is to be tightened;

an image information recording section configured to record an image captured by the camera;

a basic information registration section configured to store beforehand basic information, the basic information including information associated with a plurality of tightening operations, the basic information associated with each tightening operation including location information of the tightening operation and a type of screw associated with the tightening operation;

a determination section configured to determine whether or not new image information, which has been acquired by newly capturing a new image by the camera of the region where the screw is to be tightened, coincides with the basic information, the determination section determining whether or not the new image information coincides with the basic information by comparing information associated with the new image with location information and type of screw information stored in the basic information registration section; and a notification section that notifies a result of the determination by the determination section.

2. The screwdriver according to claim 1, wherein the basic information stored in basic information registration section includes a torque to be applied upon tightening a screw associated with each tightening operation, and the screwdriver further comprises a torque adjustment section configured to rotate the bit with the torque registered in association with the basic information determined to coincide by the determination section.

3. The screwdriver according to claim 1, wherein the image information recording section is configured to record a movie or periodically captured images.

4. The screwdriver according to claim 1, wherein the basic information stored in the basic information registration section includes a tightening sequence associated with each tightening operation associated with a turn in which a screw is to be tightened, and the determination section includes a tightening sequence determination section that determines whether the new image information determined to coincide by the determination section conforms to the associated turn.

5. The screwdriver according to claim 1, further comprising:

an information transmission section configured to transmit image information or a result of determination by the determination section to an external terminal device.

6. A screwdriver having a screwdriver main body and a bit mounted on the screwdriver main body, and configured to be connected to an electric power supply or a compressed air source to rotate the bit for tightening a screw, the screwdriver comprising:

a camera configured to capture an image of the screw to be tightened and a region where the screw is to be tightened;

an image information recording section configured to record an image captured by the camera including the image of the screw to be tightened and the region where the screw is to be tightened;

a basic information registration section configured to store beforehand basic information, the basic information including information associated with a plurality of tightening operations, the basic information associated with each tightening operation including location information of the tightening operation and a type of screw associated with the tightening operation;

a determination section configured to determine whether or not new image information, which has been acquired from a captured image by the camera of a region where a screw is to be tightened, coincides with the basic information, the determination section determining whether or not the new image information coincides with the basic information by comparing information associated with the captured image with location information and type of screw information stored in the basic information registration section; and a notification section that notifies a result of the determination by the determination section.

7. The screwdriver according to claim 6, wherein the basic information stored in basic information registration section includes a torque to be applied upon tightening a screw associated with each tightening operation, and the screwdriver further comprises a torque adjustment section configured to rotate the bit with the torque registered in association with the basic information determined to coincide by the determination section.

8. The screwdriver according to claim 6, wherein the basic information stored in the basic information registration section includes a tightening sequence associated with each tightening operation associated with a turn in which a screw is to be tightened, and the determination section includes a tightening sequence determination section that determines whether the new image information determined to coincide by the determination section conforms to the associated turn.

9. The screwdriver according to claim 6, further comprising:

an information transmission section configured to transmit image information or a result of determination by the determination section to an external terminal device.

10. A method of operating a screwdriver having a screwdriver main body and a bit mounted on the screwdriver main body, the screwdriver comprising a camera, the method comprising:

capturing an image of a screw to be tightened using the camera;

recording an image captured by the camera including the image of the screw to be tightened in an image information recording section in the screwdriver;

capturing an image of a region of an article where the screw is to be tightened;

recording the image of the region where the screw is to be tightened captured by the camera in the image information recording section in the screwdriver; and determining by a determination section of the screwdriver whether or not new image information associated with the captured image coincides with the basic information stored in a basic information registration section of the screwdriver, the basic information including information associated with a plurality of tightening operations, the basic information associated with each tightening operation including location information of an associated tightening operation and a type of screw associated with the associated tightening operation;

the determining whether or not the new image information coincides with the basic information comprising comparing information associated with the captured image with location information and type of screw information stored in the basic information registration section; and providing a notification of a result of the determining by the determination section.

11. The method of operating a screwdriver according to claim 10, further comprising:

prior to capturing the image of a screw to be tightened using the camera and prior to capturing the image of a region of an article where the screw is to be tightened:

capturing a first image of the screw to be tightened using the camera;

capturing a first image of the region of the article where the screw is to be tightened;

generating the basic information to be stored in the basic information registration section of the screwdriver from the first image of the screw to be tightened and from the image of the region of the article where the screw is to be tightened;

storing the generated basic information in the basic information registration section of the screwdriver.

12. The method of operating a screwdriver according to claim 10, wherein the basic information registration includes torque information associated with each tightening operation, the method further comprising:

determining the new image information coincides with basic information associated with one of the tightening operations;

adjusting the torque applied to the bit based on the torque information associated with the one of the tightening operations.

13. The method of operating a screwdriver according to claim 10, wherein the basic information registration includes tightening sequence information associated with each tightening operation, wherein:

the determining whether or not the new image information coincides with the basic information comprises consideration of the tightening sequence information.

* * * * *